United States Patent [19]

Foley

[11] 4,401,069

[45] Aug. 30, 1983

[54] CAMSHAFT LOBES WHICH PROVIDE SELECTIVE CYLINDER CUTOUT OF AN INTERNAL COMBUSTION ENGINE

[76] Inventor: James E. Foley, WW Ranch, St. R.D. 512, Sebastian, Fla. 32958

[21] Appl. No.: 233,298

[22] Filed: Feb. 10, 1981

[51] Int. Cl.[3] ..... F02D 13/06

[52] U.S. Cl. ..... 123/198 F; 123/90.18; 123/90.32

[58] Field of Search ..... 123/90.18, 90.15, 90.32, 123/198 F

[56] References Cited

U.S. PATENT DOCUMENTS

| | | | |
|---|---|---|---|
| 869,021 | 10/1907 | Roberts . | |
| 1,651,402 | 3/1926 | Midgley . | |
| 2,528,983 | 11/1950 | Weiss | 123/90.18 |
| 2,934,052 | 4/1960 | Longenecker | 123/90 |
| 3,277,874 | 10/1966 | Wagner | 123/90 |
| 3,638,624 | 2/1972 | O'Grady | 123/90.18 |
| 3,874,358 | 4/1975 | Crower | 123/198 |
| 3,945,367 | 3/1976 | Turner | 123/198 |
| 3,986,484 | 10/1976 | Dyer | 123/90.18 |
| 4,064,861 | 12/1977 | Schulz | 123/198 |
| 4,070,971 | 1/1978 | Studebaker | 123/198 |
| 4,131,095 | 12/1978 | Ouchi . | |
| 4,133,332 | 1/1979 | Benson et al. . | |
| 4,151,817 | 5/1979 | Mueller | 123/90.16 |
| 4,161,166 | 7/1979 | Roznovsky . | |

FOREIGN PATENT DOCUMENTS

| | | |
|---|---|---|
| 506899 | 6/1920 | France . |
| 450360 | 9/1949 | Italy . |
| 5145 | of 1906 | United Kingdom . |
| 193266 | 2/1923 | United Kingdom . |
| 2055148 | 2/1981 | United Kingdom . |

*Primary Examiner*—Ira S. Lazarus

*Attorney, Agent, or Firm*—Steele, Gould & Fried

[57] ABSTRACT

An internal combustion engine having a plurality of cylinders, at least one of the cylinders having cam-activated exhaust and intake ports and cam lobes shaped to provide selective maintenance of the exhaust port in either a continuously or periodically opened condition and the intake port in either a continuously or periodically closed condition. The cam lobes may be positioned upon a camshaft which is slidingly and rotatably disposed such that it is capable of shifting between first and second positions. The cam lobes may define first and second surfaces which activate the exhaust and intake ports as the camshaft moves from the first to the second position. The cam surfaces which maintain the exhaust and intake ports in the continuously opened and closed conditions respectively, may be cylindrical and concentric to the camshaft.

11 Claims, 14 Drawing Figures

CAMSHAFT LOBES WHICH PROVIDE SELECTIVE CYLINDER CUTOUT OF AN INTERNAL COMBUSTION ENGINE

BACKGROUND OF THE INVENTION

1. Field of the Invention

This invention relates to the field of internal combustion engines selected cylinders of which may be disabled to conserve fuel.

2. Prior Art

The internal combustion engine art has for many years been attempting to solve the problem of fuel being wasted during light load conditions due to the non-adjustment capabilities of the engine upon completion of heavy load requirements. Consequently, numerous approaches have been devised to provide an adjustment mechanism so that the engine will use less fuel during light load conditions. Typically, this is accomplished by disabling selected cylinders which ordinarily involves the interruption of the fuel flow. Some disclosures have gone as far as teaching the removal of several portions of the cylinder such that even during heavy load operation these cylinders are still ineffective, for example U.S. Pat. Nos. 3,874,358, 3,945,367 and 4,070,971. It is to be noted that in each of these references the intake and exhaust valves of the disabled cylinders are purposely maintained in a continuously closed orientation, providing an amount of vacuum and compression during the operation of the engine. To overcome this problem, U.S Pat. No. 3,874,358 teaches the substitution of pistons having passages therein to prevent these effects. U.S. Pat. No. 3,945,367 teaches connecting hoses to the opening from which the spark plug is removed to act as an intake and exhaust of air. U.S. Pat. No. 4,070,971 teaches the removal of the pistons altogether.

In an effort to maintain certain cylinders non-functional and yet maintain them in a condition for use during heavy load conditions, various push rod, rocker arm and valve devices have been described which may selectively or periodically disable particular cylinders. As was noted in U.S. Pat. No. 4,151,817 the prior U.S. patent art is replete with patents teaching valve disablement.

Few patents have included cam lobe modification in their attempt to solve the fuel waste problem. U.S. Pat. Nos. 2,934,052 and 3,277,874 disclose camshafts with high and low lift lobes for actuating each of the engine valves and means for causing the high or low lift lobe to so activate the valve. In U.S Pat. No. 2,934,052-Longenecker an actuating rod is utilized to shift the cam follower members from one lift lobe to another. However, it is specifically taught therein that none of the cylinders, on which these lift lobes operate are at any time disabled. U.S. Pat. No. 3,277,874-Wagner discloses long and short lift lobe surfaces in conjunction with a fluid operated cam follower which is apparently positioned at one end of a push rod. Apparently, fluid flowing through the cam follower will cause it to be in contact with one cam lobe surface or another.

U.S. Pat. No. 4,151,817 discloses an engine valve control mechanism wherein camshaft lobes comprise inner and outer surfaces and are caused to effect the valves of the engines disclosed therein through the use of a complex rocker arm and lash adjuster assembly. It is again shown in that reference that disablement of selected cylinders is maintained by closing both intake and exhaust valves. As was previously mentioned, vacuum and compression problems can occur if cylinders are disabled in this fashion.

U.S. Pat. No. 4,064,861-Schulz discloses an engine which allows selected cylinder disablement by interrupting the flow of the air-fuel mixture before it reaches the intake valve and by maintaining the exhaust valve in an open state. No provisions are made for the intake valve which will continue to open and close during the cylinder disablement.

None of the above cited references describes an internal combustion engine capable of selective cylinder disablement wherein the selected cylinders have cam activated exhaust and intake ports and cam lobes shaped to provide selective maintenance of the exhaust port in either a continuously or periodically opened condition and the intake port in either a continuously or periodically closed condition. In addition, none of the above-cited references disclose camshafts containing lobes with compound surfaces which are capable of longitudinal movement so that the various surfaces of the lobe can come to bear.

SUMMARY OF THE INVENTION

It is an object of the present invention to provide an internal combustion engine which is capable of minimal fuel waste during light load conditions.

It is a further object of the present invention to provide an internal combustion engine, selected cylinders of which may be disabled.

It is another object of the present invention to provide an internal combustion engine having at least one cylinder with exhaust and intake ports which are cam-activated by cam lobes which are shaped to provide selective maintenance of the exhaust port in either a continuously or periodically opened condition and the intake port in either a continuously or periodically closed condition.

These and other objects are accomplished in accordance with the principles of this invention by an internal combustion engine having a plurality of cylinders, at least one of said cylinders having cam-activated exhaust and intake ports and cam lobes shaped to provide selective maintenance of the exhaust port in either a continuously or periodically opened condition and the intake port in either a continuously or periodically closed condition. These cam lobes may be disposed on a camshaft which is slidingly and rotatably disposed in the engine. The cam lobe may be shaped such that each comprises a first and second surface and each surface is brought into contact to activate the ports by shifting the camshaft longitudinally. This longitudinal movement is preferably caused by a hydraulic cylinder which is activated in response to particular engine conditions.

BRIEF DESCRIPTION OF THE DRAWINGS

For the purposes of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENT

Figure 1:
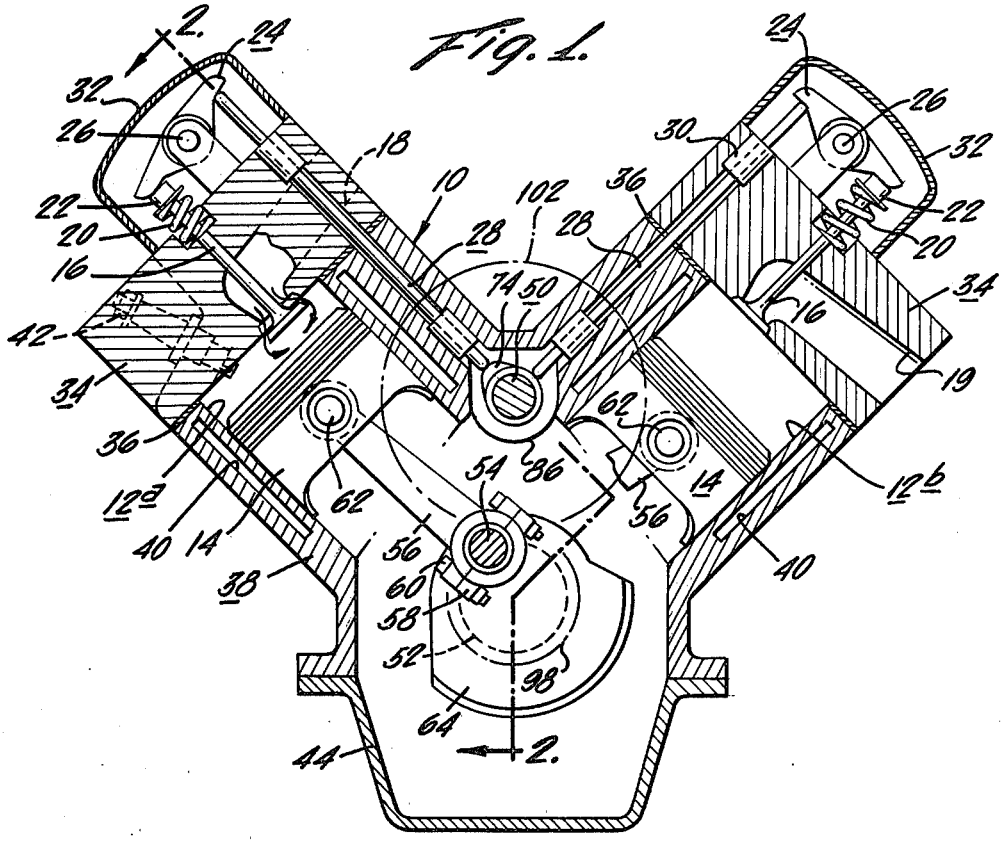
FIG. 1 is a cross-sectional view of the internal combustion engine of the present invention.

An internal combustion engine capable of disabling selected cylinders is depicted in FIG. 1 and generally referred to as 10.

The general environment of the internal combustion engine 10 is formed by engine block 38, oil pan 44 and manifolds 34. The engine 10 is of a V-type having a plurality of cylinders disposed adjacent to one another along the length of block 38. As shown in FIG. 1, cylinder 12*a* has cam activated exhaust and intake ports and cam lobes shaped to provide selective maintenance of the exhaust port in either a continuously or periodically open condition and the intake port in either a continuously or periodically closed condition. Cylinder 12*b*, while also having cam activated exhaust intake ports, does not have cam lobes which function similar to those associated with cylinder 12*a*, instead, cylinder 12*b* continues in a normal operating mode while the internal combustion engine is running.

As shown in FIG. 1, cylinder 12*a* is operating in the intake stroke, with a fuel-air mixture being drawn into the cylinders through intake port 18. The suction effect is being caused by piston 14 moving towards crankshaft 52 as the crankshaft rotates in a clockwise direction. Piston 14 is connected to crankshaft 52 by piston rod 56 rotatably connected to piston 14 by pin 62. Piston rod 56 is connected to crankshaft 52 by joining piston rod under-carriage 58 to piston rod 56 by connection bolts 60. As shown in FIG. 1, the piston rod now is rotatably connected to piston rod pivot pin 54 which is an eccentrically disposed part of crankshaft 52. Associated with cylinder 12*a* and piston 14 is a standard counterweight 64. Thus, it can be seen that as crankshaft 52 rotates in a clockwise direction, piston 14 moves into and out of cylinder 12*a*.

Coolant passages 40 are disposed within edge block 38 for the purpose of taking heat away from the cylinders to ensure a more efficient operation by preventing the degradation of lubricants contained therein or the untimely ignition of the fuel-air mixture contained therein. To maintain the cylinders in a relatively air tight relationship, gaskets 36 are interposed between manifolds 34 and engine block 38. The preferred situation being that the only fluid conductive openings in the cylinder to be the intake and exhaust ports, 18 and 19 respectively.

Figure 2:
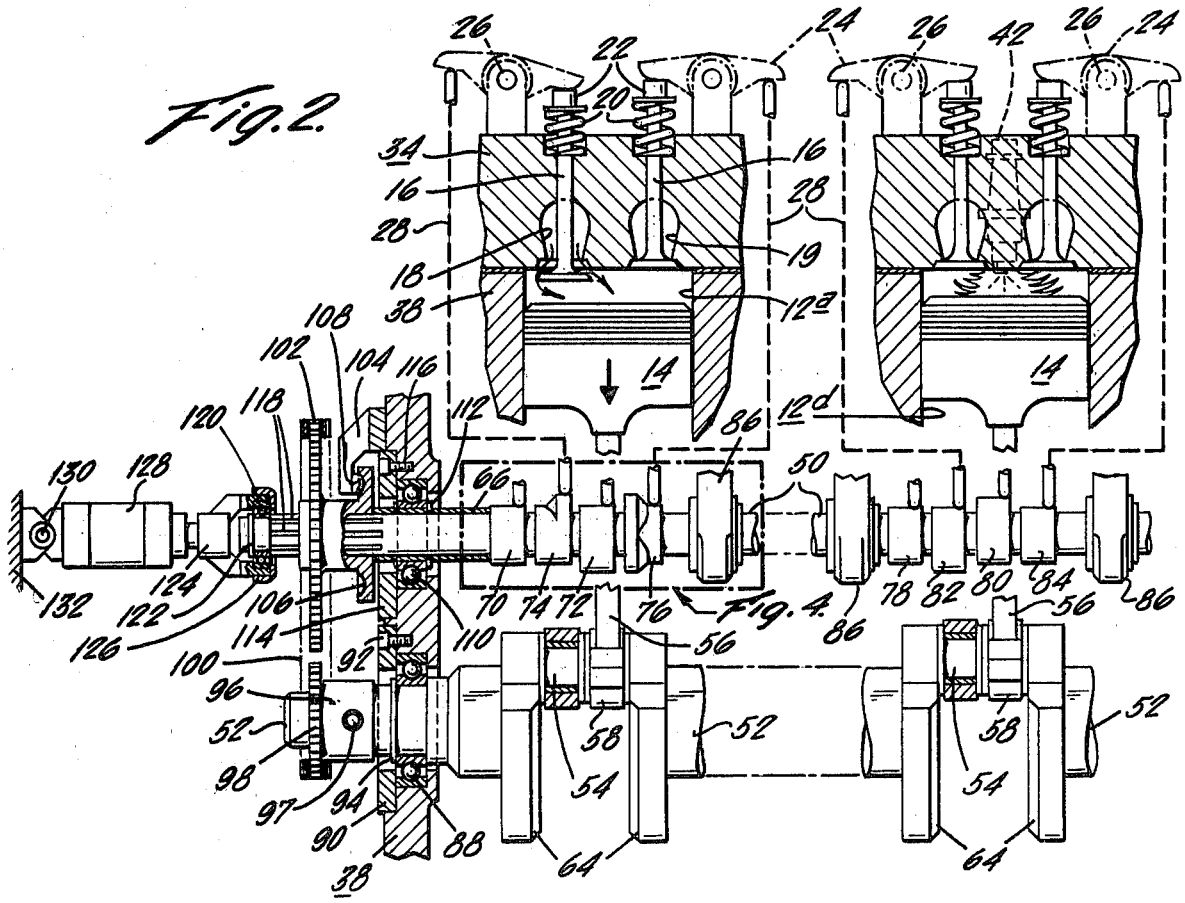
FIG. 2 is a section view along the line 2—2 of FIG. 1, wherein the rocker arms have been rotated 90° and the push rods and the piston rods have been partially schematically drawn.

Camshaft 50 is slidingly and rotatably disposed in block 38 and is held in position by camshaft positioning brackets 86. As can be seen in FIG. 1 the camshaft of the instant invention is positioned between either sides of the V-type disposed cylinders, in a standard area. Disposed on the camshaft are cam lobes shaped to provide selective maintenance of the exhaust port in either continuously or periodically open condition and the intake port in either continuously or periodically closed condition, such as cam lobe 74. Push rods 28 are slidingly disposed within push rod chamber 30 and are biased to follow the cam lobe surfaces. As shown in FIG. 1, push rod 28 associated with cylinder 12*b* is not following cam lobe 74 but is actually disposed after that lobe and is in fact following cam lobe 72 as shown in FIG. 2. The opposite ends of push rods 28 are biased against rocker arms 24. Rocker arms 24 are pivotally connected to an extension of manifold 34 by rocker pivot pin 26. The ends of rocker arms 24 which are opposite the push rods 28 are biased against spring retaining caps 22 which are securely attached to the poppet valves 16. Biasing spring 20 is securely contained between spring retaining cap 22 and manifold 34. As shown in FIG. 1, biasing spring 20 acts to keep the intake and exhaust ports in normally closed positions and also acts to maintain push rods 28 in a surface following orientation to the cam lobes securely attached to camshaft 50. Thus, it can be seen, especially in relation to cylinder 12*a*, that as the cam surface forces the push rod 28 away from camshaft 50, this motion is translated through rocker arm 24 causing movement of poppet valve 16, opening the intake port to cylinder 12*a*. Spark plugs 42 are also shown in FIG. 1 and are provided to ignite the fuel-air mixture contained in the cylinders after a compression stroke has occurred. As can be seen in FIG. 2, cylinder 12*b* has completed a compression stroke and spark plug 42 is igniting the fuel-air mixture contained therein.

Figure 3:
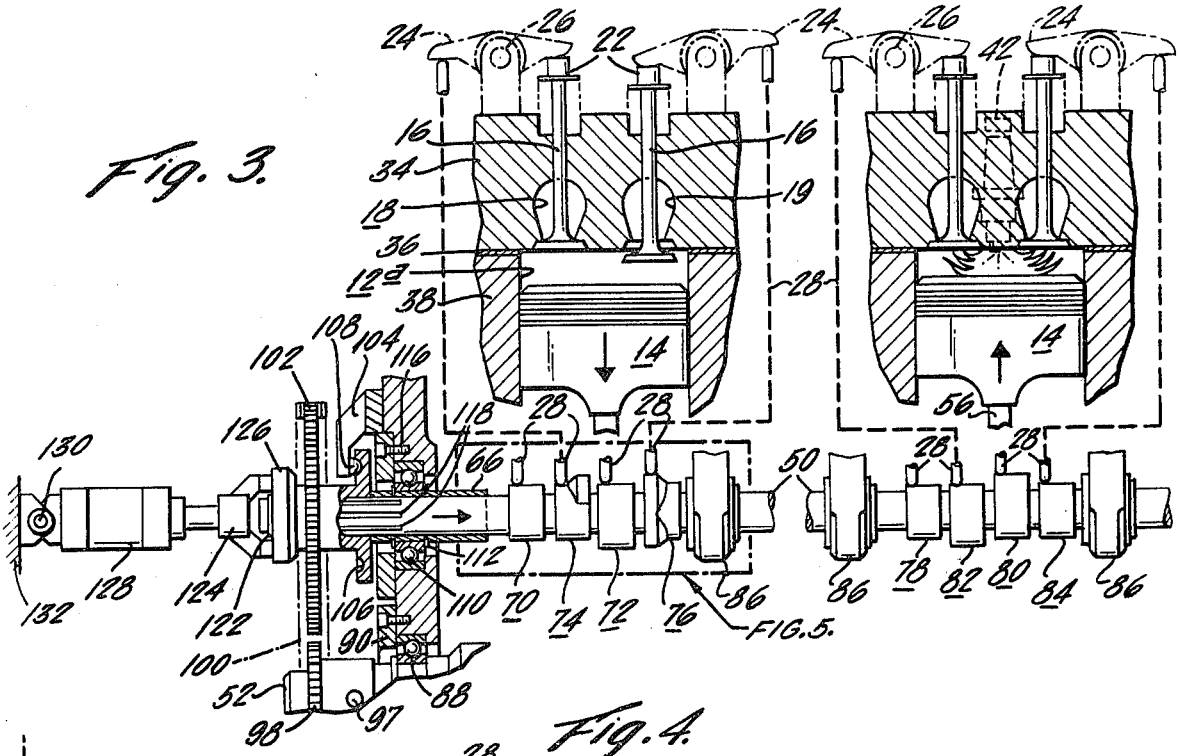
FIG. 3 is a view identical to FIG. 2 with the exceptions that portions of the crankshaft have been removed and the camshaft has shifted longitudinally.
Figure 4:
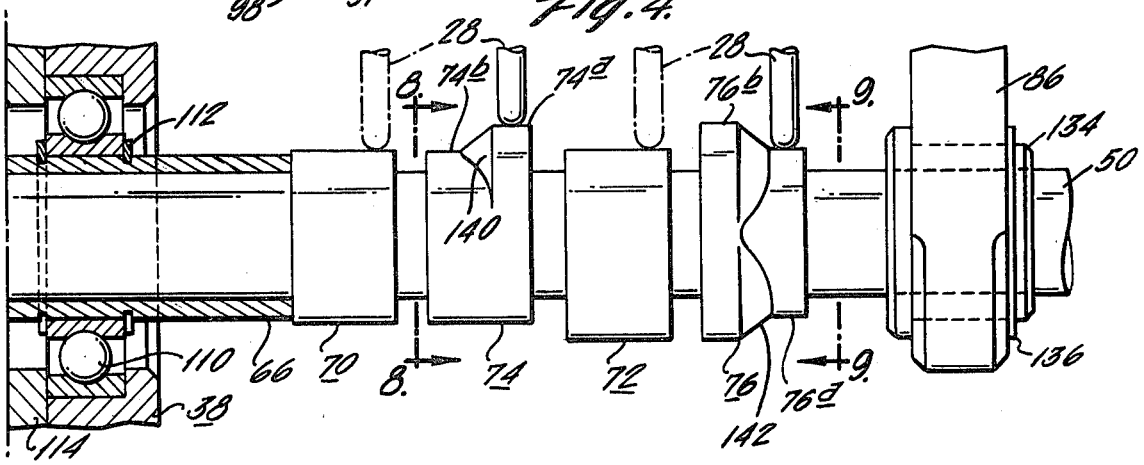
FIG. 4 is an enlarged view of a portion of the present invention, outlined by the box shown in FIG. 2.
Figure 5:
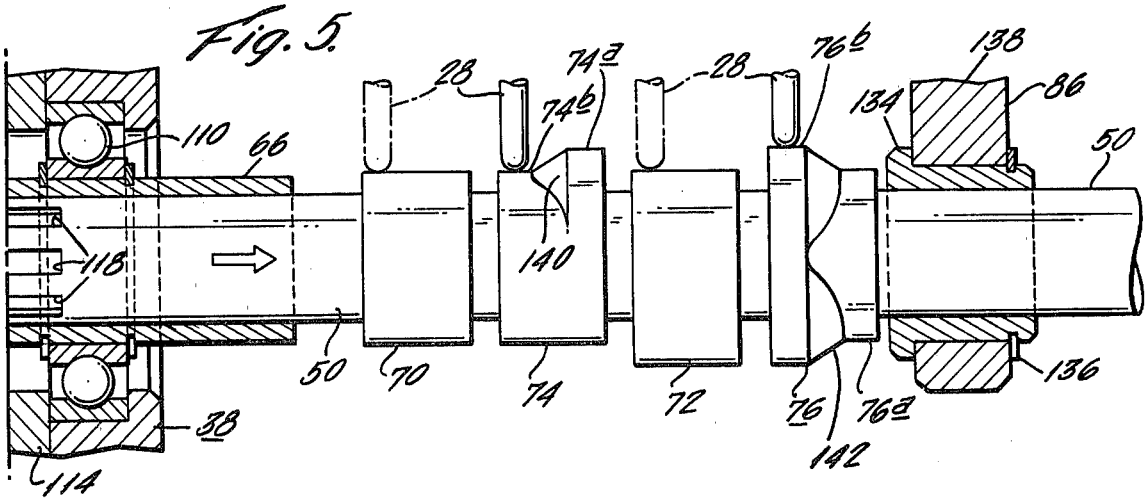
FIG. 5 is a view identical to FIG. 4 except that the camshaft positioning bracket has been partially cut away and the camshaft has shifted longitudinally.

Referring to FIG. 2, and more specifically to the area of camshaft 50, outlined in FIG. 4, there is securely attached to camshaft 50 exhaust cam lobe 76 comprising a first surface which maintains the exhaust port of cylinder 12*a* in a periodically open condition against which push rod 28 is biased; and a second surface which maintains the exhaust port of cylinder 12*a* in a continuously open condition. Intake cam lobe 74 is securely attached, as are all the cam lobes, to camshaft 50 and is shown to comprise a first surface, upon which push rod 28 is following and which first surface maintains intake port 18 in a periodically closed condition. Cam lobe 74 also comprises a second surface which maintains exhaust port 18 in a continuously closed condition. Referring to FIG. 4, camshaft 50 is disposed in a first position and push rods 28 are following the first surfaces of the intake and exhaust cam lobes, which maintain the intake and exhaust ports in periodically closed and open positions. In FIG. 5, camshaft 50 has been longitudinally shifted to a second position such that push rods 28 are now following the second surfaces of cam lobes 74 and 76. The intake and exhaust ports of cylinder 12*a* are now maintained in continuously closed and continuously open positions, respectively. The means for shifting camshaft 50 longitudinally are specifically shown in FIGS. 2 and 3 and will be discussed in greater detail herein.

As can be seen in FIGS. 2, 3, 4 and 5, the cam lobes contained between each camshaft positioning bracket 86, operate the ports of cylinders disposed on opposite sides of block 38, and are arranged in the normal fashion as intake, intake, exhaust and exhaust lobes. The arrangement of the lobes to one another with respect to operation of an intake or exhaust port is not a part of the invention and these lobes could have alternative arrangements such as intake, exhaust, intake, exhaust. Cam lobes 70 and 72 which are associated with cylinder 12*b* are not capable of maintaining the exhaust and intake ports in a continuously open and closed position respectively.

As can be more clearly seen in FIGS. 8, 9, 10 and 11 the second surfaces of cam lobes which maintain the exhaust and intake ports in a continuously open and closed positions respectively are cylindrical and concentric to the camshaft 50. It is, of course, understood that in high compression internal combustion engines, the method or manner of maintaining the exhaust port in a continuously open condition will be responsive to the rising action of piston in the cylinder. It is, of course, preferred that the piston head not strike the exhaust poppet valve. This can be accomplished by either making an appropriate indentation in the cam lobe surface to allow a brief movement of the poppet valve to avoid the cylinder head, or, make the distance the poppet valve extends into the cylinder sufficiently small so that the cylinder head does not strike the poppet valve.

As shown in FIG. 2, crankshaft 52 is rotatably disposed within block 38 by positioning therebetween crankshaft bearing 88. Bearing 88 is secured to crankshaft 52 by means of crankshaft bearing positioning C-ring 94. Bearing 88 is securely attached to block 38 by means of crankshaft bearing securement ring 90 which is securely attached to block 38 by bolt 92. Crankshaft gear 98 is securely attached to the crankshaft 52 by means of bolt 97. Bolt 97 passes through the body 96 of crankshaft gear 98 into the crankshaft. The rotational movement of the cranskshaft is transmitted to the camshaft by means of camshaft gear actuation chain 100 which connects the crankshaft gear 98 to the camshaft gear 102. As in normal engine operation, the circumference of camshaft gear 102 is two times greater than the circumference of crankshaft gear 98. Thus, the crankshaft will rotate twice to a single rotation of the camshaft. Camshaft gear 102 is held in place by means of camshaft gear retaining fingers 104. It is preferred that three retaining fingers 104 be positioned 120° apart around the circumference of the camshaft gear. Only one of these fingers is shown in FIG. 2 and all are securely attached to block 38.

As was previously mentioned, camshaft 50 is slidingly and rotatably disposed within block 38 by means of camshaft positioning brackets 86. Camshaft 50 extends through block 38 and is slidingly and may be rotatably disposed within camshaft rotation tube 66. Camshaft rotation tube 66 is securely attached to camshaft bearing 110 by means of camshaft bearing positioning C-rings 112. Bearing 110 is securely attached to block 38 by means of camshaft bearing securement ring 114. Securement ring 114 is securely attached to block 38 by bolt 116. The rotational movement of gear 102 is transmitted to the camshaft by means of splined ridges 118 contained on the camshaft surface and which pass through corresponding grooves in gear 102.

As can be seen in FIG. 5, camshaft positioning brackets 86 comprise the camshaft being slidably and rotatably positioned within camshaft sleeve bearing 134 which in turn is securely attached to bracket 138 by means of sleeve bearing securement ring 136. Thus, it can be seen that the camshaft 50 is capable of longitudinal movement during rotation.

The means for longitudinally shifting the camshaft is shown in FIGS. 2 and 3 as comprising an hydraulic cylinder 128. The ram portion of the hydraulic cylinder is attached to one end of camshaft 50 by means of camshaft grasping chuck 124. Chuck 124 is attached to camshaft 50 by being securely attached to bearing 120 by bearing securement ring 126. Bearing 120 is securely attached to camshaft 50 by means of bearing positioning C-ring 122. As can be seen in FIG. 2, C-ring 122 holds the bearing 120 against the splined ridges 118 in camshaft 50. Hydraulic cylinder 128 is pivotally attached by pin 130 to a base 132, which may be an extension of block 38 or may comprise a secure part of the machine in which engine 10 has been positioned. Since internal combustion engines are presently flexibly attached to automobiles such that engine vibrations are substantially absorbed by the attachments, it will be necessary for the hydraulic cylinder to be mounted to block 38 or an extension thereof. Also, it is recognized that in contemporary engines, the placement of the hydraulic cylinder as shown in FIG. 2, may interfer with the operation of a water pump (not shown in the Drawings) if the engine is water cooled. In such a situation, the mechanism for longitudinally shifting the camshaft may be positioned on the rear of the engine, or in such other location as to prevent interference with the operation of other parts of the engine. Thus, as hydraulic cylinder 128 is activated, chuck 124 causes camshaft 50 to move longitudinally without interference with its rotational movement. As can be seen in FIGS. 2 and 3, the camshaft gear 102 while being held in position by retaining fingers 104, rotates freely due to retaining finger bearing 108, positioned at the point of contact with gear 102, riding or following in retaining finger bearing path 106. The source of fluid for activating the hydraulic cylinder has not been shown in the drawings and is preferred to be done in the normal fashion. While it is preferred to use hydraulic cylinder 128, an hydraulic, pneumatic, solenoid or manual device can also be utilized.

It can be seen in FIG. 3, that camshaft 50 has been shifted to a second position such that push rods 28 of cylinder 12*a* are now following the second surfaces of cam lobes 74 and 76. The intake port 18 remains continuously closed and exhaust port 19 is continuously open, disabling that cylinder and preventing compression or vacuum effects. As can been in FIGS. 8 and 9, and more clearly in FIGS. 10 and 11, cam lobes 74 and 76 contain first surfaces 74*a* and 76*a* and second surfaces 76*b* and 76*b*. As push rods 28 follow the lobe from the "a" surfaces to the "b" surfaces, there is provided intake side surface 140 and exhaust side surface 142, which significantly reduce the side stress load on each push rod. It is preferred that the inclination or shape of these side surfaces 140 and 142 be shaped in response to the side stress tolerances of the push rods being utilized in engine 10. This will ensure that as camshaft 50 moves from a first position to a second position push rods 28 will not bend due to the side stress load placed on them. This could of course be accomplished by raising or lowering the angle of inclination of each side surface. Side stress forces could also be reduced by increasing the length of the lift lobe surface and reducing the height of same. Since camshaft 50 is slidably and rotatably disposed in block 38, side stress forces can be reduced by allowing more rotation of the camshaft during longitudinal shifting. Thus, pushrods 28 do not abruptly move from the "a" surfaces to the "b" surfaces, but rather, move diagonally across the sidesurfaces, such as 140 and 142.

In an alternative embodiment, the means for shifting the camshaft longitudinally comprises a lever arm which is pivotally attached to the block 38. One end of the lever arm is attached to the camshaft and the other end of the lever arm is attached to an hydraulic cylinder, or other cylinder capable of pivoting this arm. As can be seen in FIG. 12*a*, lever arm 166 is pivotally attached to bracket 170 by means of pin 172. Bracket 170 is securely attached to block 38. Hydraulic cylinder 162 is pivotally attached to one end of lever 166 by attaching the lever arm grasping chuck 164 to the lever arm by pin 168. The other end 174 of lever arm 166 is securely but pivotally attached to bearing 176 by pin 178. Bearing 176 is in turn securely attached to camshaft 50. Thus, upon activating cylinder 162 the lever arm 166 will pivot about pin 172 forcing bearing 176 and camshaft 50 to move in a longitudinal direction.

In an alternative embodiment of the present invention, the "normal" cam lobes of engine 10 also define a plurality of surfaces, such that when camshaft 50 is in said first position or when the engine is in high speed operation, push rods 28 are following relatively long lift lobe surfaces. Some overlap between the closing of the exhaust port and the opening of the intake port will occur. After camshaft 50 has been shifted longitudinally such that push rods 28, in FIG. 5, are now following the second surfaces associated with cam lobe 74 and 76, the push rods, which follow the "normal" cam lobe surfaces, would then be provided with shorter lift. Short lift cam lobes provide higher fuel efficiency during low speed operation.

Figure 12:
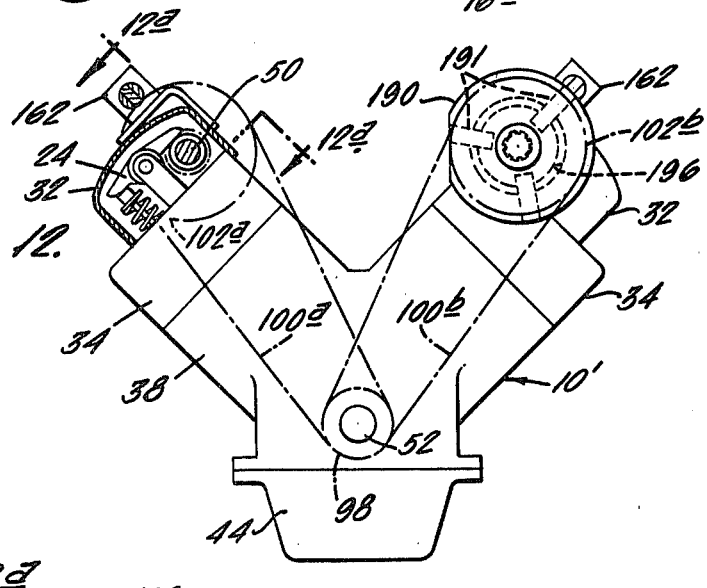
FIG. 12 is a front view of an alternative embodiment of the present invention.
Figure 12A:
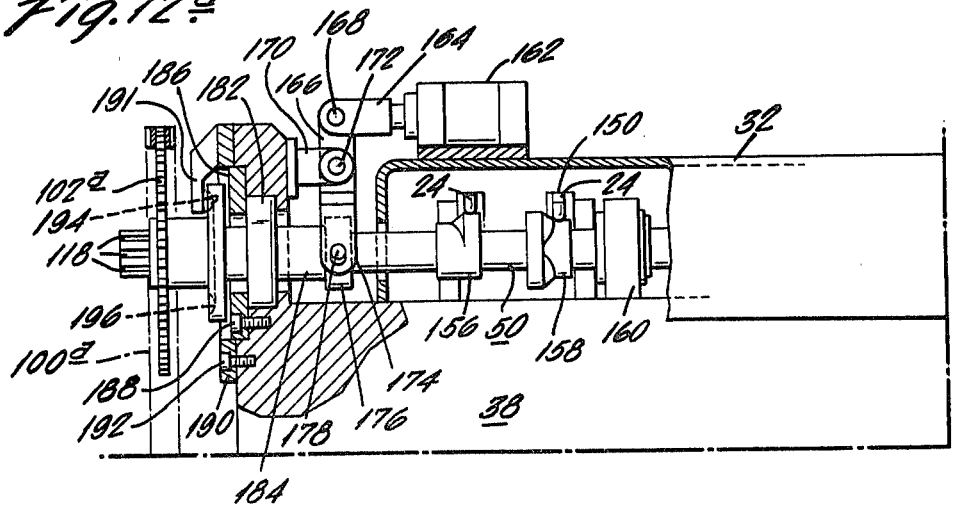
FIG. 12*a* is a section view along the line 12*a*-12*a* of FIG. 12.

In FIG. 12, an alternative embodiment of the present invention is shown wherein push rods 28 have been eliminated and rocker arms 24 are resting directly on camshaft 50. This arrangement is commonly known as an engine having an overhead cam. As can be seen in FIG. 12, the circumference of crankshaft gear 98 is half that of the circumference of camshaft gears 102*a* or 102*b*. As in the preferred embodiment, the camshaft gears are activated by chains 100*a* and 100*b* respectively. As can be seen in FIG. 12*a*, hydraulic cylinder 162 has been securely attached to cover 32. Camshaft 50 is slidingly and rotatably disposed beneath the rocker arms 150, which have been adapted at one end to follow the cam surfaces, and the camshaft positioning brackets 160. Since there are now two camshafts which activate the rocker arms of engine 10, there are only two cam lobes shown over cylinder 12*a*. The rocker arms 150 are activated by cam lobe surfaces 156 and 158 which are identical to cam lobes 74 and 76 respectively. It should be noted that since in this embodiment the cam lobe surfaces can cover more of the longitudinal area of camshaft 50 than in the preferred embodiment, it may be possible to position the camshaft in 1, 2, 3 or 4 positions, each position corresponding to more or less disablement of selected cylinders. The camshaft is again rotatably and slidingly disposed within the sleeve 184 which is securely attached to camshaft bearing 182. Bearing 182 is in turn securely attached to block 38 by means of camshaft bearing securement ring 186 which is secured to block 38 by bolt 188. Similar to FIGS. 2 and 3, the end of camshaft 50 contains splined ridges 118 which pass through corresponding grooves in camshaft gear 100*a*. Also similar to FIGS. 2 and 3, camshaft gear 100*a* is held in position by camshaft gear retaining fingers 191 which are disposed at 120° intervals about finger base 190. Base 190 is securely attached to block 38 by bolt 192. To reduce friction between retaining finger 191 and gear 100*a*, retaining finger bearing 194 has been positioned on the end of retaining finger 191 and follows in retaining finger bearing path 196 disposed on gear 100*a*. Thus it has been seen that by shifting camshaft 50 from a first to a second position, selected cylinders have been disabled.

In an eight cylinder, six cylinder or four cylinder internal combustion engine, it is preferred if every other cylinder in the firing order has associated with it intake and exhaust cam lobes such as cam lobes 74 and 76 shown in FIGS. 4 and 5. It is additionally preferred that if the instant invention is used in an automobile that the means for longitudinally shifting the cam, i.e. the hydraulic, pneumatic or solenoid cylinder, be responsive to the transmission, speedometer or other light load indicator, such that when the automobile reaches a pre-selected speed, or load condition, the cylinder is activated and the camshaft shifts, disabling selected cylinders therein.

Figure 13:
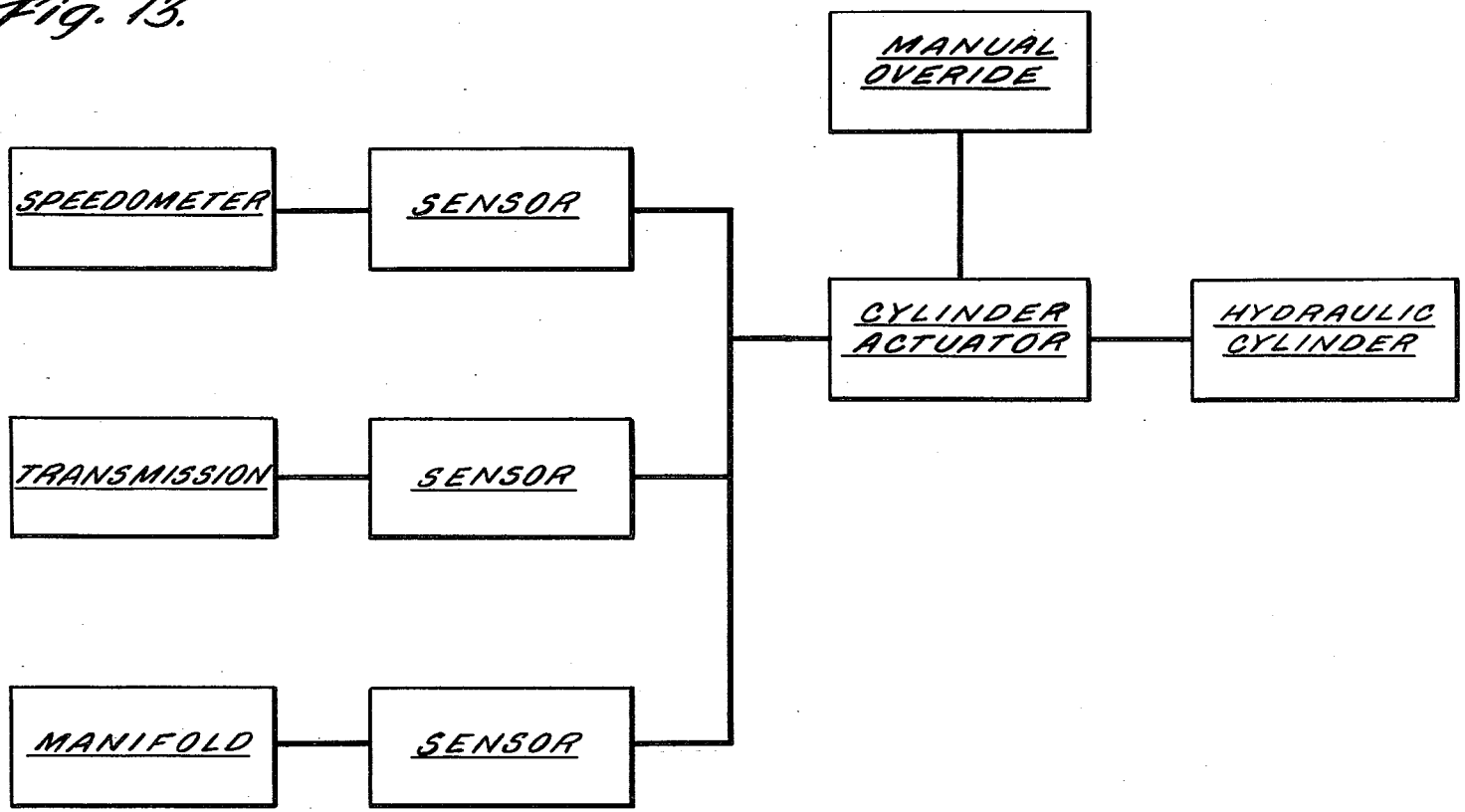
FIG. 13 is a flow chart showing the activation of the means for shifting the camshaft in response to light load engine conditions.

FIG. 13 is a schematic diagram showing this operation. A sensor is connected to the speedometer, manifold, or the transmission, to determine when the automobile reaches a pre-selected speed, where the engine 10 will be operating under light load or heavy load conditions. The sensor connected to the manifold will be responsive to light pressure conditions. It will be remembered that when the engine is in the light load state, the disablement of selected cylinders will allow both the maintenance of power output and better fuel economy. The sensors will then signal the cylinder activator which, in the preferred embodiment, will supply the appropriate hydraulic fluid to the hydraulic cylinder, shifting camshaft 50 longitudinally from the first position to the second position, or the reverse. There is also provided a manual override so that the number of operating cylinders may be reduced or increased at any time.

It is also preferred that when the camshaft shifts it does so at a point of rotation which allows the least amount of total opening of all intake ports being deactivated. In other words, as normal operation continues, the intake port is periodically closed, opening when the push rod follows a lift surface of the cam lobe. When the camshaft is shifting, inevitably certain of the intake ports will be open. It is therefore preferred that the total amount of opening of all the intake ports being effected by this invention, be kept at a minimum, thus keeping fuel use at a minimum. An indentation or small raised area could be located on the surface of the camshaft which is sensed by a device which prevents the longitudinal shifting of the camshaft. Thus, if the engine is in a light load condition, such that the hydraulic cylinder is being activated, such activation will not take place until the marking on the camshaft passes the sensor, ensuring a camshaft rotational position at the time of longitudinal shifting.

Figure 6:
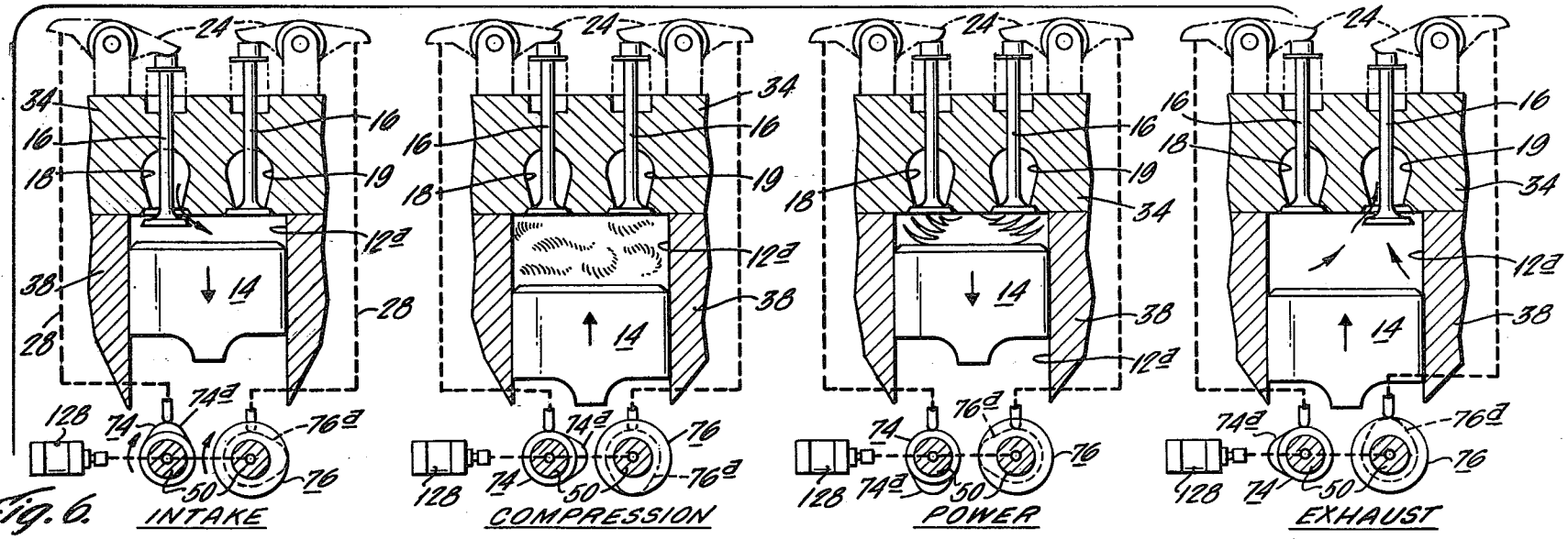
FIG. 6 is four schematic views of a single cylinder during each stroke-phase of engine operation, relating the poppet valves to the camshaft position and hydraulic ram position.
Figure 7:
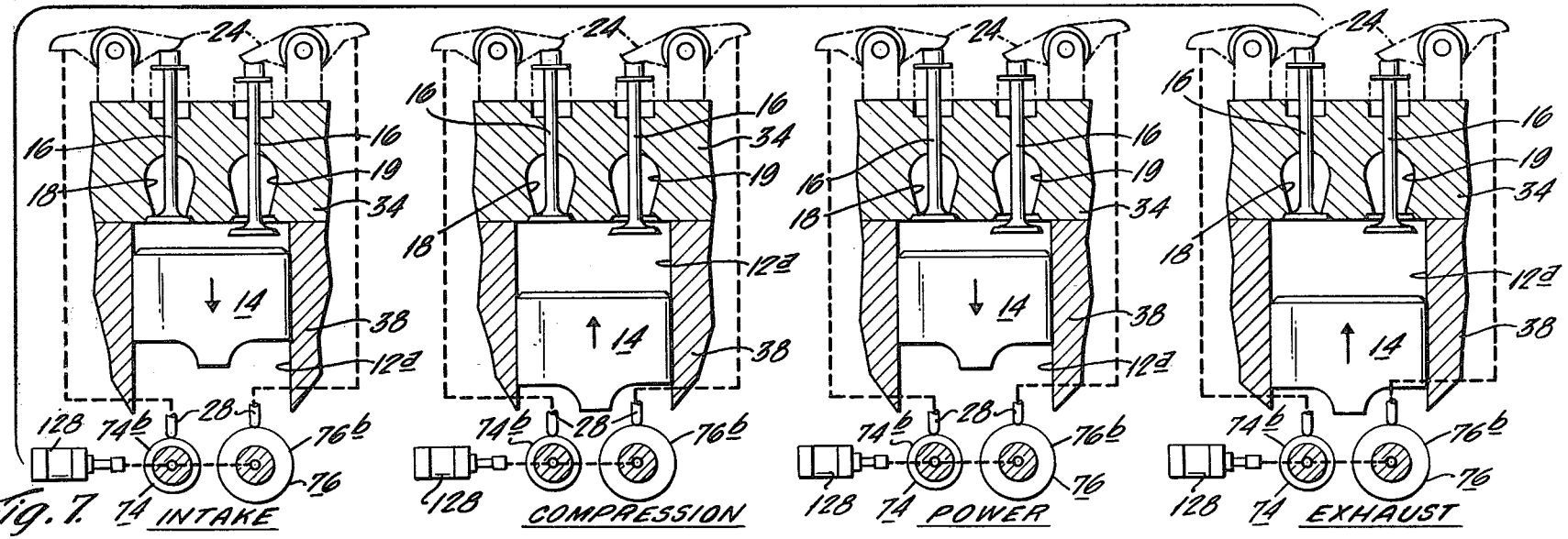
FIG. 7 is four schematic drawings of a single cylinder during each of the stroke-phases of engine operation, relating the poppet valves, rocker arms and push rods to the cam lobe surface brought to bear after the hydraulic ram is extended.
Figure 8:
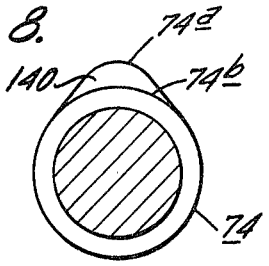
FIG. 8 is a section view along the line 8—8 of FIG. 4.
Figure 9:
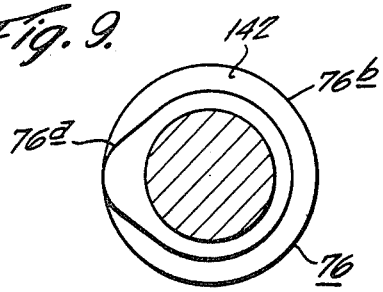
FIG. 9 is a section view along the line 9—9 of FIG. 4.
Figure 10:
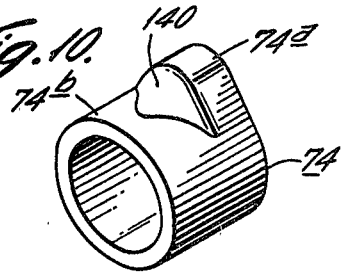
FIG. 10 is a perspective view of the cam lobe surfaces of FIG. 8.
Figure 11:
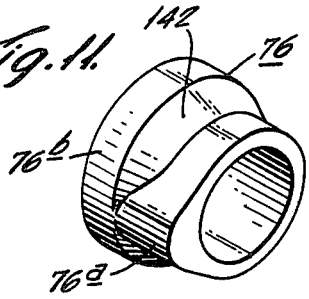
FIG. 11 is a perspective view of the cam lobe surfaces of FIG. 9.

FIGS. 6 and 7 show the invention during each stroke of a single cylinder both before and after the hydraulic cylinder has been activated. Referring to the intake schematic of FIG. 6, there is shown the intake lobe forcing the push rod upward which opens the intake port into the cylinder. A fuel-air mixture is drawn into the cylinder by the downward motion of the piston. As the piston moves towards the intake and exhaust ports, as shown in the compression schematic of FIG. 6, the air-fuel mixture is compressed and neither push rod is lifted, thus ensuring the closed position of the intake and exhaust poppet valves. Referring to the power schematic of FIG. 6, the spark plug has ignited the compressed air-fuel mixture and is forcing the piston away from the intake and exhaust ports. As was shown in the compression schematic, neither push rod is activated by the surface of the cam lobes, thus ensuring the closed position of the intake and exhaust poppet valves. Referring to the exhaust schematic of FIG. 6, the piston is again moving towards the intake and exhaust valves. The exhaust cam lobe surface has forced the push rod away from the camshaft thus forcing the exhaust poppet valve to open. The rising action of the piston forces the gasses contained in the cylinder out through the open exhaust valve.

As can be seen in FIG. 7, the hydraulic cylinder has been activated causing the camshaft to shift longitudinally which in turn forces the push rods to follow the second surface of the cam lobes. As can be seen in each stroke, the push rod associated with the intake port poppet valve does not move away from the camshaft, thus ensuring the closure of the intake valve during each stroke of the engine. Since no air-fuel mixture may enter the cylinder, this cylinder has been effectively disabled. To prevent compression or vacuum effects from acting upon the cylinder, the exhaust push rod has been moved away from the camshaft in each of the four strokes of the engine. Thus, the exhaust poppet valve is maintained in a continuously open position during each stroke of the engine, completing this cylinder disablement. As hereinbefore discussed, high compression internal combustion engines require the continuous open position of the exhaust poppet valve to be responsive to the rising action of the piston in the cylinder. Since no air-fuel mixture is being used or ignited in the cylinder during this phase of operation, and since the piston does not act to compress or diesel any gasses in the cylinder, the piston will freely move therein. Thus, a person using the instant invention, will save fuel, thereby saving money, due to the non-necessity of a large number of cylinders to operate an automobile at high speed.

The present invention may be embodied in other specific forms without departing from the spirit or essential attribute thereof, and, accordingly, reference should be made to the appended Claims, rather than the foregoing Specifications as indicating the scope of the invention.

I claim:

1. An internal combustion engine, having a plurality of cylinders, comprising:

an axially displaceable cam shaft;

a plurality of cams fixed for rotation together with the cam shaft;

each of the cylinders having an intake and an exhaust valve, each valve being operable by a cam-activated push rod;

at least one, but not all of the cylinders having an intake valve operable by a first multiple lobe cam having at least two push rod activating lobes, one of the lobes having an eccentric circumferential surface relative to the cam shaft axis for periodically opening and closing the intake valve, and the other of the at least two lobes having a sufficiently small radius, throughout its circumference, to prevent the intake valve from opening, and at the same time, having a sufficiently large radius, throughout its circumference, to nevertheless maintain contact with the push rod, the cam further having a transition surface on which the push rod can easily slide between the lobes;

the exhaust valve of the at least one cylinder being operable by a second multiple lobe cam having at least two push rod activating lobes, one of the lobes having an eccentric circumferential surface relative to the cam shaft axis for periodically opening and closing the exhaust valve, and the other of the at least two lobes having a sufficiently large radius, throughout its circumference, to prevent the exhaust valve from closing, the cam further having a transition surface on which the push rod can easily slide between the lobes;

the remaining cams having at least one push rod activating lobe, the lobes having an eccentric circumferential surface relative to the cam shaft axis for periodically opening and closing the remainder of the intake and exhaust valves, the multiple lobe cams and the remaining cams having substantially equal axial width; and, the respective lobes of the multiple lobe cams being selectively positionable to engage and activate the push rods through axial displacement of the cam shaft during operation of the engine, whereby the at least one cylinder may be selectively disabled, without interfering with normal operation of the remaining cylinders, to improve gas mileage.

2. The internal combustion engine of claim 1, comprising eight cylinders, two of which having intake and exhaust valves operated by the multiple lobe cams, whereby two of the eight cylinders may be selectively disabled.

3. The internal combustion engine of claim 1, comprising eight cylinders, four of which having intake and exhaust valves operated by the multiple lobe cams, whereby four of the eight cylinders may be selectively disabled.

4. The internal combustion engine of claim 1, comprising six cylinders, two of which having intake and exhaust valves operated by the multiple lobe cams, whereby two of the six cylinders may be selectively disabled.

5. The internal combustion engine of claim 1, comprising six cylinders, three of which having intake and exhaust valves operated by the multiple lobe cams, whereby three of the six cylinders may be selectively disabled.

6. The internal combustion engine of claim 3, wherein the multiple lobe cams are so arranged that every other cylinder in the firing order may be selectively disabled.

7. The internal combustion engine of claim 5, wherein the multiple lobe cams are so arranged that every other cylinder in the firing order may be selectively disabled.

8. The internal combustion engine of claim 1, further comprising means for axially displacing the camshaft.

9. The internal combustion engine of claim 8, wherein the means for axially displacing the camshaft comprises a lever arm pivotally mounted on the engine, one end of which is attached to the cam shaft and the other end of which is attached to an hydraulic cylinder.

10. The internal combustion engine of claim 8, further comprising means for automatically activating the hydraulic cylinder in response to engine load and other operating parameters.

11. The internal combustion engine of claim 10, further comprising means for manually activating the hydraulic cylinder.

* * * * *